US006105385A

United States Patent [19]

Kato et al.

[11] Patent Number: 6,105,385

[45] Date of Patent: Aug. 22, 2000

[54] FLOW DOWN TYPE ICE MAKER

[75] Inventors: Sonoo Kato; Hatsuo Yamada; Tadashi Sakai, all of Aichi-ken, Japan; Douglas Troy Steward, Newnan, Ga.

[73] Assignee: Hoshizaki Denki Kabushiki Kaisha, Aichi-ken, Japan

[21] Appl. No.: 09/184,980

[22] Filed: Nov. 3, 1998

[30] Foreign Application Priority Data

Nov. 7, 1997 [JP] Japan ..... 9-305522

[51] Int. Cl.[7] ..... F25C 1/12

[52] U.S. Cl. ..... 62/347

[58] Field of Search ..... 62/74, 347, 348

[56] References Cited

U.S. PATENT DOCUMENTS

| | | | |
|---|---|---|---|
| 3,913,349 | 10/1975 | Johnson | 62/348 |
| 4,938,030 | 7/1990 | Josten et al. | 62/348 |
| 5,426,954 | 6/1995 | Furukawa | 62/347 |
| 5,520,011 | 5/1996 | Hibino | 62/347 |
| 5,924,301 | 7/1999 | Cook | 62/347 |

*Primary Examiner*—William E. Tapolcai
*Attorney, Agent, or Firm*—Wenderoth, Lind & Ponack, L.L.P.

[57] ABSTRACT

An object of the present invention is to prevent ice making water from splashing outside of an ice making water tank with a simple means. Flat members are provided at the right and left outermost portions of an ice making unit such that the front ends, the rear ends and the lower ends of the flat members are elongated forward, rearward and downward with respect to the front ends, the rear ends and the lower ends of the ice making plates to prevent the ice making water from splashing to the right and left outside of the ice making plates. Moreover the flat members can be provided as side plates comprising the ice making unit. Further, notches can be provided at the lower front corner portions of the side plates. Or a front cover having an inclined portion with the lower end inclined to the rearward can be provided forward the front of the ice making unit.

12 Claims, 4 Drawing Sheets

FLOW DOWN TYPE ICE MAKER

BACKGROUND OF THE INVENTION

1. Field of the Invention

The present invention relates to a flow down type ice maker, more specifically to technology for preventing unfrozen ice making water falling from an ice making plate from splashing outside of a tank.

2. Description of the Related Art

FIG. 4 shows the vicinity of an ice making unit 1 of a common conventional flow down type ice maker. The ice making unit 1 is provided with, a pair of ice making plates 3 having a plurality of angled portions 2 at fixed intervals, and these projecting angled portions 2 are formed vertically from the upper end to the lower end of the ice making plates 3 and arranged symmetrically such that there are angled portions 2 facing both to the front and the rear, and a cooling tube 4 constituting an evaporator of a coolant circuit supported by a side plate 5 between the ice making plates 3. An ice making water tank 6 is provided below the ice making plates 3. Further, a sprinkler (not illustrated) is provided above the ice making unit 1 so that the ice making water can be sprayed between the angled portions 2 on the front or rear surface of the ice making plates 3. The ice making operation is conducted by gradually freezing the ice making water on the ice making plate surfaces between the angled portions 2, and a circulating system is formed wherein the ice making plates 3 are cooled by the cooling tube 4, ice making water is sprayed on the cooled ice making plates 3 from the sprinkler, and the ice making water is received in the ice making water tank 6 and sprayed again from the sprinkler.

As mentioned above, the ice making water circulates in the ice making water tank 6, the sprinkler, and the ice making unit 1. However, the ice making water sprayed from the sprinkler to the ice making unit 1 so as to flow down on the front surface (or the rear surface) of the ice making plates 3 tends to flow towards the front side (or the rear side) and towards the sides as shown by the broken arrows in FIG. 5 due to the cross-sectional shape of the angled portions 2 having widths that become narrower toward the tip, as shown in FIG. 5.

Therefore, particularly at the outermost portions of the ice making unit 1, the ice making water splashes toward the front, the rear, and the sides from the lower end of the ice making unit 1 so as to fall outside of the ice making water tank 6. Consequently, ice cannot be made in a predetermined amount or with a predetermined size and the water that falls adhere to ice in the ice stocker and melts it, and the melted ice adheres to other ice and re-freezes into a large lump. Further, since the ice making water that is cooled while flowing down the ice making plates 3 cannot be reused for making ice, the cooling efficiency is degraded. As a countermeasure to this problem, a method wherein a larger ice making water tank with a larger mouth area is used so that ice making water is not splashed outside the ice making water tank can be considered. However, since this creates another problem in that the ice maker as a whole becomes larger, it dose not fundamentally solve the problem.

SUMMARY OF THE INVENTION

Accordingly, in order to solve the problems with the conventional flow down type ice maker, an object of the present invention is to prevent the ice making water from splashing outside the ice making water tank with a simple means.

In order to achieve the above-mentioned object, a first aspect of the present invention is a flow down type ice maker comprising an ice making unit having pair of ice making plates arranged to the front and rear, a cooling tube as an evaporator provided between the ice making plates, and a plurality of angled portions for partitioning ice on the outer surfaces of ice making plates, wherein ice making water flows down from the upper portion thereof so as to freeze between the angled portions, an ice making water tank provided below the ice making unit for receiving the ice making water flowing down from the ice making unit, and an ice stocker for storing the ice made in the ice making unit in an insulated chamber, wherein flat members are provided at the right and left outermost portions of the ice making unit, with the front ends, rear ends, and lower ends of the flat members elongated beyond the front ends, rear ends, and lower ends of the ice making plates in the forward, rearward, and downward directions, respectively, so as to prevent the ice making water from splashing outside of the right and left sides of the ice making unit.

In a second aspect of the present invention, the lower front corner portion of the flat members is notched so that the ice making water flowing down while contacting the inner surfaces of the flat members is guided to the ice making water tank by the notch edges.

In a third aspect of the present invention, a front cover is provided on the front side of the ice making unit.

In a fourth aspect of the present invention, a rear wall of the insulated chamber is provided behind the ice making unit and above the ice making water tank.

In a fifth aspect of the present invention, the lower end of the front cover is inclined to the backward.

In a sixth aspect of the present invention, the flat members are side plates comprising side component members of the ice making unit.

According to the flow down type ice maker of the first aspect, since the front ends, the rear ends, and the lower ends of the flat members are elongated beyond the front ends, the rear ends, and the lower ends of the ice making plates in the forward, rearward and downward directions, respectively, by a distance necessary to prevent the ice making water flowing from the right and left outermost portions of the ice making plates to the outside from splashing outside of the ice making water tank, the ice making water flowing from the right and left outermost portions of the ice making plates to the outside is deflected by the flat members, guided downward by the flat members and falls into the ice making water tank.

According to the flow down type ice maker of the second aspect, the ice making water flowing down the flat members is guided to the upper portion of the ice making water tank by the notch edges, and then falls into the ice making water tank.

According to the flow down type ice maker of the third aspect, the ice making water flowing from the front ice making plate to the front side is deflected by the front cover. Therefore, since the portions of the ice making water flowing forward diagonally from the side portions of the ice making plates are also deflected by the front cover, the forward elongation dimension of the flat members can be decreased. Further, the ice making water deflected by the front cover is also guided into the ice making water tank by the front cover.

According to the flow down type ice maker of the fourth aspect, the ice making water flowing from the rear ice making plate to the rear can be deflected by the rear wall of the insulated chamber. Further, the ice making water deflected by the rear wall is guided into the ice making water tank.

According to the flow down type ice maker of the fifth aspect, since the ice making water flowing down on the inside of the front cover is directed forward the rear at the lower end portion of the front cover, the mouth portion of the ice making water tank can be disposed forward the rear.

According to the flow down type ice maker of the sixth aspect, since side plates of the ice making unit is used as the flat members, the device can be constructed without adding flat plates.

DESCRIPTION OF THE PREFERRED EMBODIMENT

Figure 1:
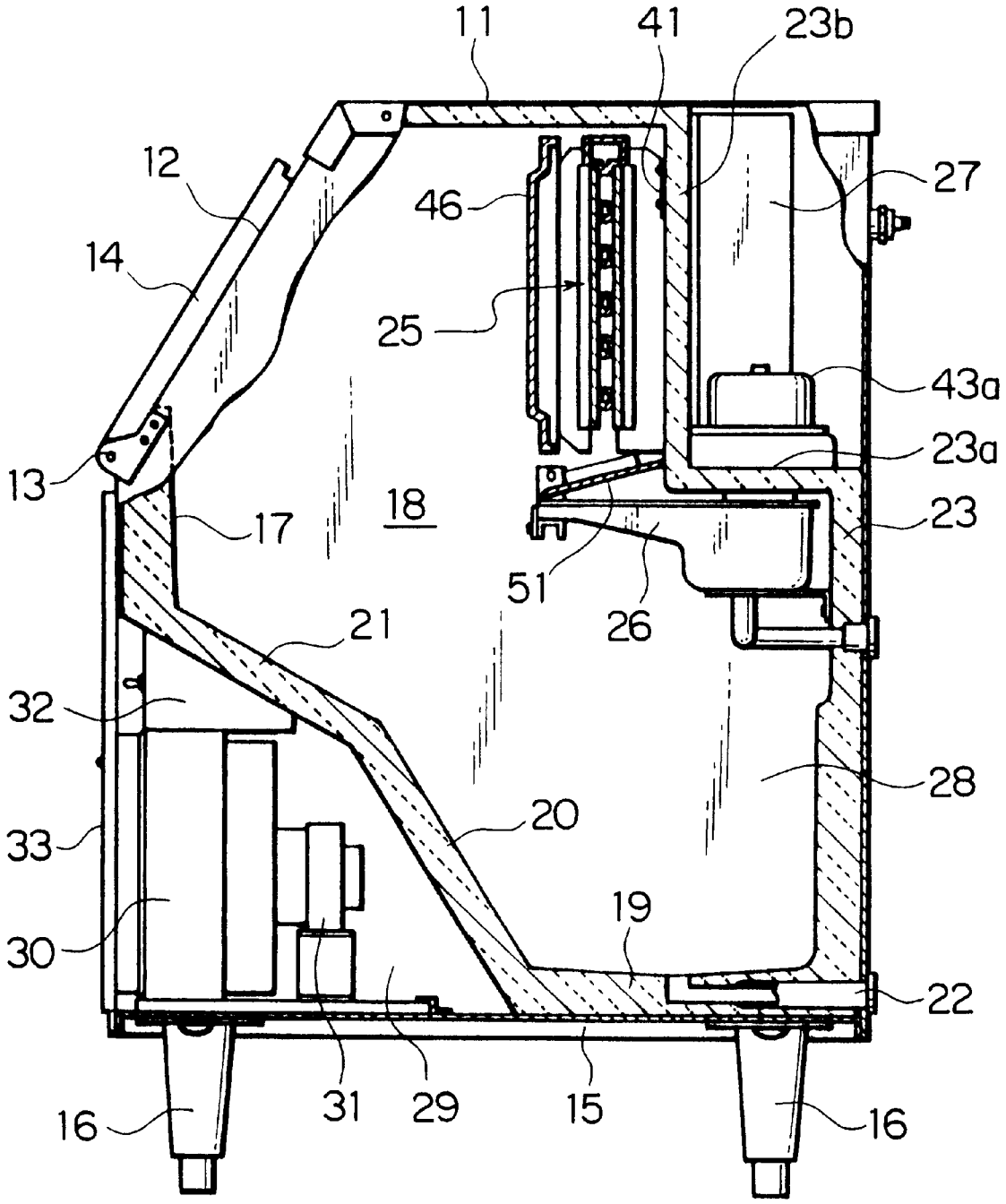
FIG. 1 is a cross-sectional side view of a flow down type ice maker of an embodiment of the present invention.

Hereinafter a preferred embodiment of the present invention will be explained with reference to the accompanying drawings. FIG. 1 is a cross-sectional side view of a flow down type crescent ice maker according to the present embodiment. An external case 11 is a housing made from stainless steel provided with an opening 12 for taking-out ice at an upper front portion thereof. The opening 12 can be opened and closed with a lid 14 pivotally attached to the external case 11 via fitting members 13. The external case 11 has a square base plate 15, and a plurality of supporting legs 16 are provided on the lower surface of the base plate 15.

An insulated chamber 18 made of an insulating material 17 is formed in the external case 11. The bottom wall 19 of the insulated chamber 18 is disposed to the rear above the base plate 15. A first front wall portion 20 extends diagonally upward from the front end portion of the bottom wall 19. Further, a second front wall portion 21 extends diagonally from the front end portion of the first front wall portion 20. A drain discharge outlet 22 is provided at the bottom wall 19 of the insulated chamber 18.

The rear wall 23 of the insulated chamber 18 is formed such that it is stepped with a horizontal wall 23*a* and an upper wall 23*b* provided at a forward position. An ice making unit 25, to be described later in detail, is mounted to the front side of the upper wall 23*b*, that is, the inside of the insulated chamber 18. Further, an ice making water tank 26 having an upward opening mouth for receiving the ice making water flowing down from the ice making unit 25 is provided below the ice making unit 25 and the horizontal wall 23*a*. The rear side of the upper wall 23*b* serves as a mechanical room for storing a drive motor 43*a* of a pump 43 and an electrical equipment case 27 described later.

The lower portion of the insulated chamber 18, that is, the portion below the ice making water tank 26 serves as an ice stocker 28 for storing ice produced by the ice making unit 25. Another mechanical room 29 is provided at the lower front portion of the ice stocker 28. A freezing unit including a condenser 30, a condenser fan motor 31, a compressor (not illustrated), and the like as its components is installed in the mechanical room 29. An electrical equipment case 32 housing electrical equipment for driving the freezing unit is provided in the upper portion of the mechanical room 29. A front panel 33 having ventilation openings is detachably mounted on the front portion of the mechanical room 29.

Figure 2:
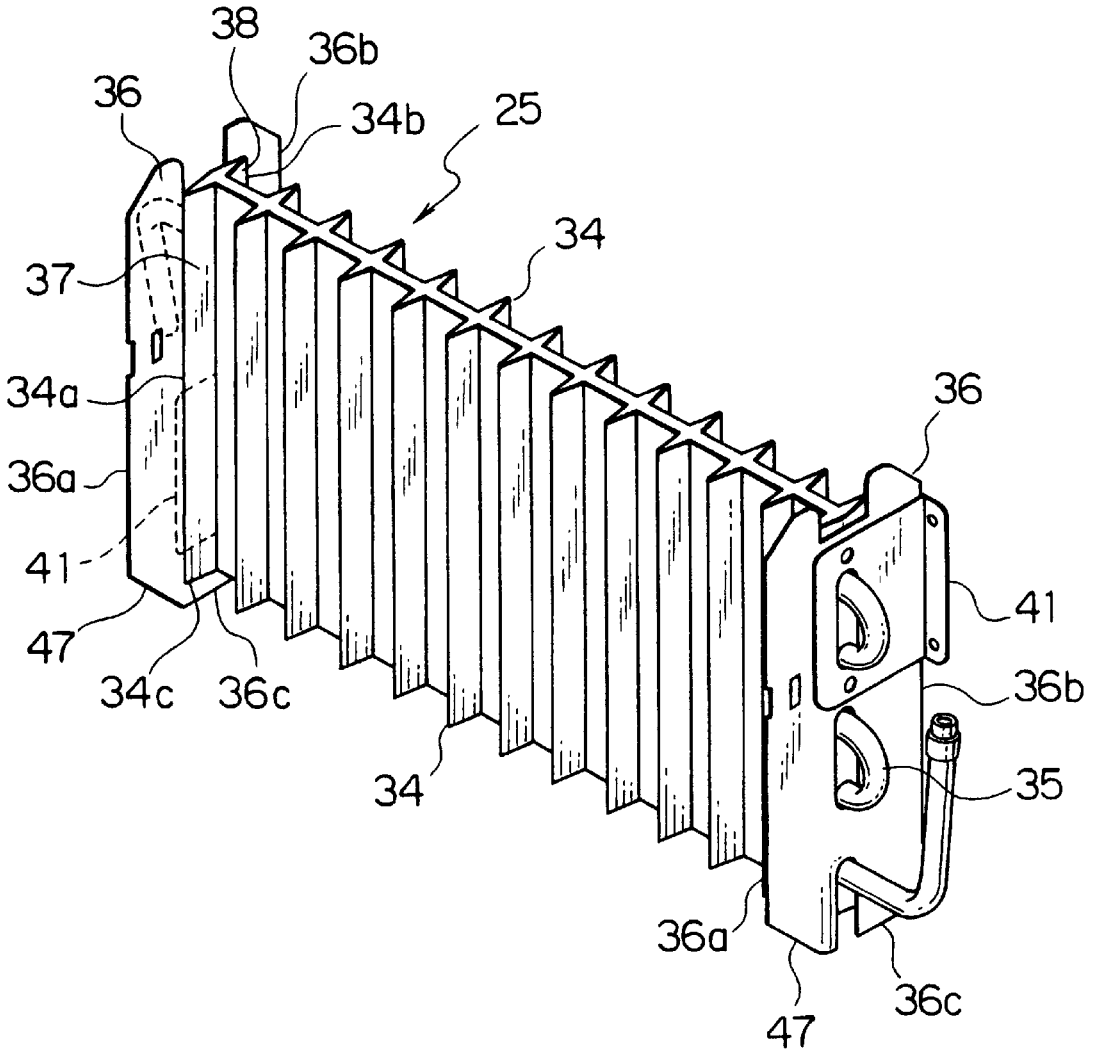
FIG. 2 is a perspective view of ice making plates of the flow down type ice maker of the embodiment.

With reference to FIG. 2, the ice making unit 25 will be explained. The ice making unit 25 comprises a pair of ice making plates 34 arranged to the front and rear, a cooling tube 35 comprising an evaporator provided therebetween, and flat side plates 36 mounted to the right and left sides of the ice making plates 34 at outermost portion of the ice making unit 25.

A plurality of angled portions, elongated from the upper to the lower ends of the ice making plates 34 are formed at fixed intervals on the outer surface of each ice making plate 34. The meandering cooling tube 35 comprising an evaporator of a coolant circuit is provided between the pair of ice making plates 34. The cooling tube 35 is supported by long holes provided on the right and left side plates 36 so as to be fixed at a predetermined position.

The front ends 36*a*, the rear ends 36*b* and the lower ends 36*c* of the side plates 36 are elongated beyond the front ends 34*a*, the rear ends 34*b* and the lower ends 34*c* of the ice making plates 34 in the forward, rearward, and downward directions, respectively. The elongation dimensions of the front ends 36*a*, the rear ends 36*b*, and the lower ends 36*c* are set to values necessary to prevent the ice making water falling from the right and left outermost portions of the ice making plates 34 from being splashed outside the ice making water tank 26. A bracket 41 is mounted to the right and left side plates 36, respectively, so that the ice making unit 25 can be fixed to the front surface of the upper wall 23*b* (see FIG. 1).

Figure 3:
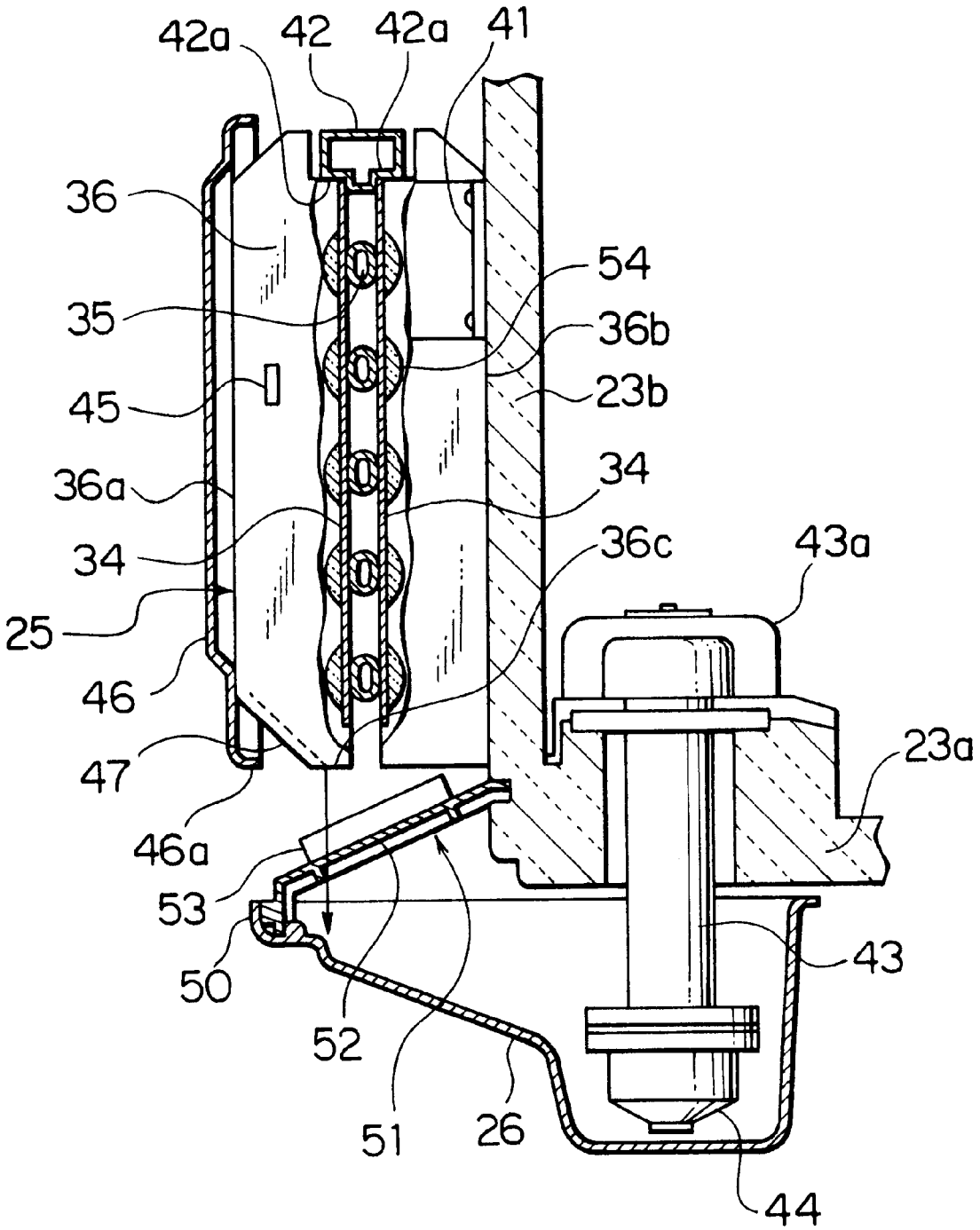
FIG. 3 is a side cross-sectional view of the vicinity of an ice making unit of the flow down type ice maker of the embodiment.
Figure 4:
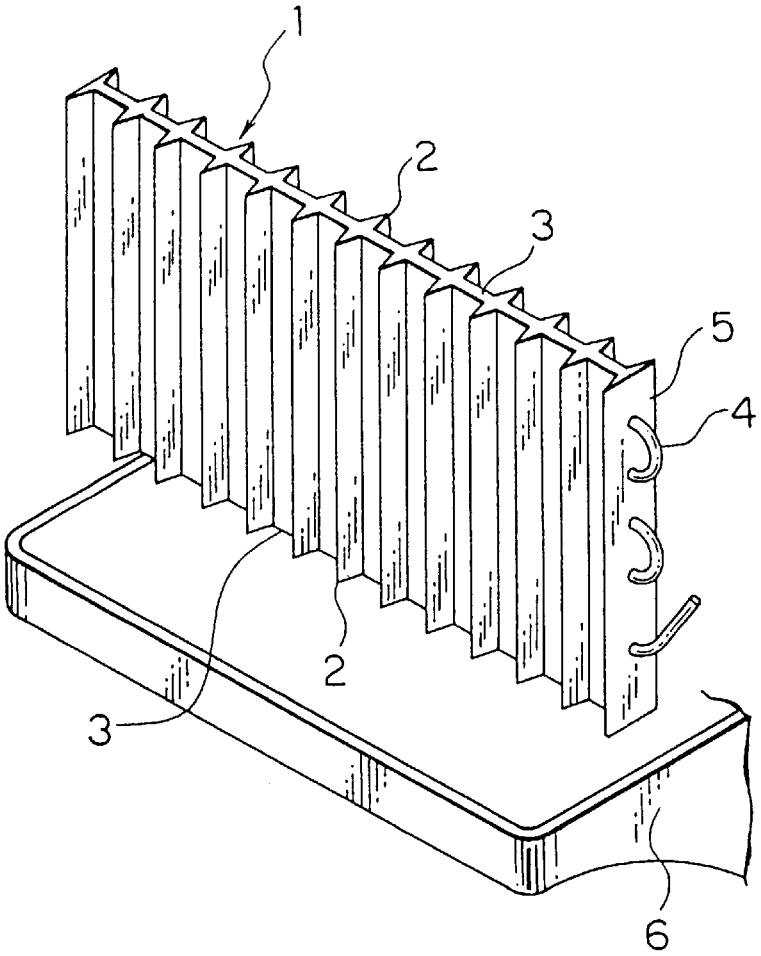
FIG. 4 PRIOR ART
FIG. 4 is a perspective view of the vicinity of a conventional ice making unit of a flow down type ice maker.
Figure 5:
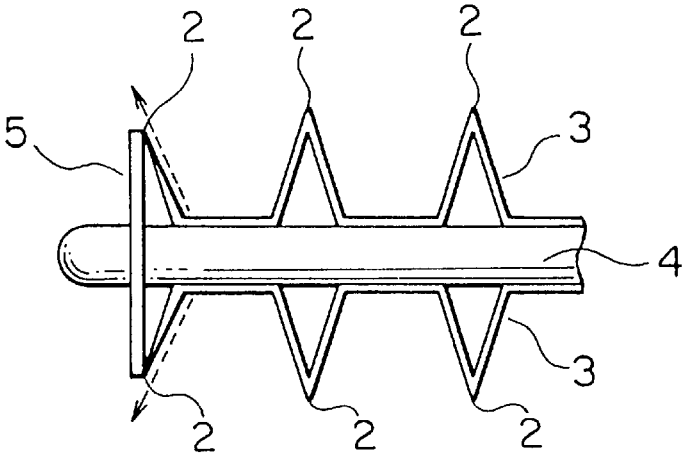
FIG. 5 PRIOR ART
FIG. 5 is an upper surfaces view of the outermost portions of ice making plates of the conventional flow down type ice maker.

As shown in FIG. 3, a rectangular hole 45 is provided on the side plates 36 so that the front cover 46 can be mounted to the side plates 36 via a hook (not illustrated) that engages with the hole 45. The front cover 46 covers the front surface of the ice making unit 25 with the front ends 36*a* of the side plates 36 stored therein. An inclined portion 46*a* is provided at the lower end of the front cover 46, inclined toward the rear to guide the ice making water flowing down rearward. Also notches 47 are provided for guiding the ice making water flowing down rearward at the lower front compartments of the side plates 36 so as not to disturb the receipt of the ice making water that is splashed sideways. A sprinkler 42 is provided above the ice making plates 34 for spraying the ice making water. Sprinkling holes 42*a* are formed in the bottom portion of the sprinkler 42 for spraying the ice making water to the space partitioned by the angled portions.

Moreover, the ice making water tank 26 with an upward opening mouth is provided from the ice making unit 25 to below the horizontal wall 23*a* for receiving the ice making water and circulating the ice making water flowing down from the ice making unit 25. The portion of the ice making water tank 26 below the horizontal wall 23*a* is the deep portion, and is provided with a suction opening 44 of a pump 43. The discharge opening of pump 43 is connected to the sprinkler 42 via a water supply pipe (not illustrated). The right and left ends of the mouth portion of the ice making water tank 26 are formed slightly to the outside of the right and left side plates 36. The front rim 50 of the mouth portion of the ice making water tank 26, the tip of the inclined portion 46*a* formed at the lower end of the front cover 46, and the lower ends of the notches 47 provided at the lower front corner portions of the side plates 36 are arranged such that the front rim 50 is formed forward with respect to the tip of the inclined portion 46a and the lower ends of the notch 47.

An ice guide plate 51 is provided between the ice making unit 25 and the ice making water tank 26. The ice guide plate 51 has a guide surface 52 inclined in the vertical direction so that ice falling from the surfaces of the ice making plates 34 can drop onto the guide surface 52, slide on the guide surface 52 forward the front end of the ice guide plate 51, and drop into the ice stocker 28 (see FIG. 1) in the lower portion of the insulated chamber 18. The guide surface 52 is provided with a plurality of water passage apertures so that the ice making water falling from the ice making plates 34 can be guided therethrough into the ice making water tank 26 provided below. A lip portions 53 are formed on the right and left sides of the ice guide plate 51 so that the ice or the ice making water sliding down the guide surface 52 cannot drop from the right and left sides of the ice guide plate 51.

Next, the operation of the above-mentioned flow down type crescent ice maker will be explained. The ice making water in the ice making water tank 26 is sent to the sprinkler 42 by the pump 43 so as to be sprayed onto the ice making plates 34 below. Since a low temperature coolant flows in the cooling tube 35, ice is gradually formed in the vicinity of the cooling tube 35 of the ice making plate 34. The ice making water that does not freeze on the ice making plates 34 flows down into the ice making water tank 26 and is sent to the sprinkler 42 by the pump 43.

While circulating the ice making water as mentioned above, crescent shaped ice 54 can be made in the vicinity of the cooling tube 35 of the ice making plates 34 as shown in FIG. 3. Then a hot gas is controlled so as to flow in the cooling tube 35 to detach the crescent ice 54 with the heat of the hot gas when it grows to a desired size. The falling crescent ice 54 is guided by the ice guide plate 51 so as to be stored in the ice stocker 28.

The ice making water flowing down along the angled portions of the ice making plates 34 in the ice making operation has a tendency to flow forward, rearward, and downward as explained in "Description of the Related Art" so that it tends to splash forward, rearward or downward. Nevertheless, the ice making water will be guided to the ice making water tank 26 via the route mentioned below.

The ice making water directed sideways from the front ends 34*a* and the lower ends 34*c* while flowing down the inner surfaces 37 (see FIG. 2) of the angled portions provided at the outermost side of the front ice making plate 34, and the ice making water directed sideways from the rear end 34*b* and the lower end 34*c* while flowing down the inner surfaces 38 (see FIG. 2) of the angled portions provided at the outermost side of the rear ice making plate 34 is deflected by the side plates 36 so as to flow down along the side plates 36. This phenomenon will be described in further detail. The front ends 36*a,* the rear ends 36*b* and the lower ends 36*c* of the side plates 36 are elongated forward, rearward and downward from the front ends 34*a*, the rear ends 34*b* and the lower ends 34*c* of the ice making plates 34 for the length necessary to prevent the ice making water from splashing outside of the ice making water tank 26. According to this configuration, the ice making water directed sideways can be deflected by the side plates 36 and flows down along the side plates 36. Therefore, the ice making water can be prevented from splashing outside of the ice making water tank 26 without enlarging the mouth in the longitudinal direction.

The ice making water flowing forward diagonally from the tips of the front ice making plate 34 contacts the front cover 46 and flows downward along the front cover 46 so as to fall into the ice making water tank 26 from the inclined portion 46*a* of the front cover 46. Since the ice making water can be prevented from splashing forward by the front cover 46, the front rim 50 of the ice making water tank 26 can be provided at a rearward position.

When the ice making water flowing down along the side plates 36 reaches the edges of the notches 47 formed at the lower front corner portion of the side plates 36, it is guided inside the front rim 50 of the ice making water tank 26 along the edges of the notches 47 so that it falls into the ice making water tank 26 from the lower ends of the notches 47. Furthermore, since the inclined portion 46*a* of the front cover 46 is inclined to the rear and terminates rearward of the front rim 50 of the ice making water tank 26, the ice making water from the inclined portion 46*a* falls from a rearward position and securely into the ice making water tank 26. Since the ice making water deflected by the side plates 36 is guided rearward from the edges of the notches 47, and the ice making water deflected by the front cover 46 is guided rearward by the inclined portion 46*a,* the front rim 50 of the ice making water tank 26 can be provided toward the rear by the amount that the ice making water is guided so that the ice making water tank 26 can be made smaller.

Next, the ice making water flowing rearward diagonally from the tips of the angled portions of the rear ice making plate 34 contact the upper wall 23*b* of the rear wall 23, and flows downward along the upper wall 23*b* so as to fall into the ice making water tank 26 provided below the upper wall 23*b*. Therefore, by providing the ice making unit 25 near the upper wall 23*b*, the area of the mouth portion of the ice making water tank 26 can be made smaller.

The present invention is not limited to the embodiment heretofore explained, but can be implemented, for example, with the following modifications.

That is, the side plates 36 can be formed integrally with the ice making plates 34, with the ends thereof elongated forward, rearward, and downward.

As an embodiment with another modification, the surfaces of the brackets 41 for fixing the ice making unit 25 along the side plates 36 can be made flat, with the front ends, the rear ends and the lower ends of the flat portions of the brackets 41 elongated forward, rearward and downward, respectively, with respect to the ice making plates 34, instead of elongating the ends of the side plates 36.

As heretofore mentioned, according to the flow down type ice maker of the first aspect of the present invention, ice making water can be prevented from splashing outside of the ice making water tank without having to enlarge the ice making water tank by using simple cost-effective flat members, and elongating the front ends, the rear ends and the lower ends of the flat members forward, rearward and downward with respect to the front ends, the rear ends and the lower ends of the ice making plates.

According to the flow down type ice maker of the second aspect, since the ice making water is guided rearward by and falls from the notch edges, the mouth portion of the ice making water tank can be provided forward the rear so that the ice making water can be prevented from splashing outside of the ice making water tank while decreasing the cross directional dimension of the ice making water tank.

According to the flow down type ice maker of the third aspect, the ice making water flowing down from the front ice making plate to the front can be regulated by the front cover so that the ice making water can be prevented from splashing outside of the ice making water tank.

According to the flow down type ice maker of the fourth aspect, the ice making water flowing from the rear ice making plate to the rear can be regulated by the rear wall of the insulated chamber so that it can be prevented from splashing outside of the ice making water tank.

According to the flow down type ice maker of the fifth aspect, since the-ice making water flowing down on the inside of the front cover is directed rearward at the lower end portion of the front cover, the mouth portion of the ice making water tank can be provided to the rear.

According to the flow down type ice maker of the sixth aspect, since the side plates comprising the ice making unit are used as the flat members, the ice making water can be prevented from splashing sideways by only slightly enlarging the side plates.

What is claimed is:

1. A flow down type ice maker comprising an ice making unit having a pair of ice making plates arranged to the front and rear, a cooling tube as an evaporator provided between the ice making plates, and a plurality of angled portions for partitioning ice on the outer surfaces of ice making plates, wherein ice making water flows down from the upper portion thereof so as to freeze between the angled portions, an ice making water tank provided below the ice making unit for receiving the ice making water flowing down from the ice making unit, and an ice stocker for storing ice made in the ice making unit in an insulated chamber, Wherein flat members are provided at the right and left outermost portions of the ice making unit, with front ends, rear ends, and lower ends of the flat members elongated beyond front ends, rear ends, and lower ends of the ice making plates in the forward, rearward, and downward directions, respectively, so as to prevent the ice making water from splashing outside of the right and left sides of the ice making unit.

2. The flow down type ice maker according to claim 1, wherein the lower front corner portions of the flat members are notched so that the ice making water flowing down while contacting the inner surfaces of the flat members is guided to the ice making water tank by the notch edges.

3. The flow down type ice maker according to claim 1, wherein a front cover is provided on the front side of the ice making unit.

4. The flow down type ice maker according to claim 3, wherein a rear wall of the insulated chamber is provided behind the ice making unit and above the ice making water tank.

5. The flow down type ice maker according to claim 3, wherein the lower end of the front cover is inclined to the backward.

6. The flow down type ice maker according to claim 1, wherein the flat members are side plates comprising side component members of the ice making unit.

7. The flow down type ice maker according to claim 2, wherein a front cover is provided on the front side of the ice making unit.

8. The flow down type ice maker according to claim 4, wherein the lower end of the front cover is inclined to the backward.

9. The flow down type ice maker according to claim 2, wherein the flat members are side plates comprising side component members of the ice making unit.

10. The flow down type ice maker according to claim 3, wherein the flat members are side plates comprising side component members of the ice making unit.

11. The flow down type ice maker according to claim 4, wherein the flat members are side plates comprising side component members of the ice making unit.

12. The flow down type ice maker according to claim 5, wherein the flat members are side plates comprising side component members of the ice making unit.

* * * * *